US010952575B1

(12) United States Patent
Whyte, Jr. et al.

(10) Patent No.: US 10,952,575 B1
(45) Date of Patent: Mar. 23, 2021

(54) TOILET ARRANGEMENT FACILITATING COMFORTABLE SITTING OF A USER FOR A PROLONGED TIME

(71) Applicants: Melroy Whyte, Jr., Pompano Beach, FL (US); Melroy Whyte, Sr., Pompano Beach, FL (US); Nicholas Amos, Pompano Beach, FL (US)

(72) Inventors: Melroy Whyte, Jr., Pompano Beach, FL (US); Melroy Whyte, Sr., Pompano Beach, FL (US); Nicholas Amos, Pompano Beach, FL (US)

( * ) Notice: Subject to any disclaimer, the term of this patent is extended or adjusted under 35 U.S.C. 154(b) by 92 days.

(21) Appl. No.: 16/251,304

(22) Filed: Jan. 18, 2019

(51) Int. Cl.
*A47K 13/28* (2006.01)
*A47K 13/10* (2006.01)

(52) U.S. Cl.
CPC ..... *A47K 13/28* (2013.01); *A47K 13/10* (2013.01)

(58) Field of Classification Search
CPC ..... A47K 13/28; A47K 13/10
USPC ..... 4/254
See application file for complete search history.

(56) References Cited

U.S. PATENT DOCUMENTS 3,215,469 A * 11/1965 Wamsley ..... A61G 5/125 297/344.18
3,905,051 A * 9/1975 Gozdziewski ..... A47C 15/004 4/661
5,309,583 A * 5/1994 White ..... A61G 7/1007 297/DIG. 10
6,539,558 B2 4/2003 Shero
6,742,195 B1 * 6/2004 Parry ..... A47K 11/04 4/239
6,931,684 B1 * 8/2005 Henegar ..... A61G 7/02 5/604
8,863,321 B2 * 10/2014 Schottenstein ..... A47C 7/62 4/234
9,126,548 B1 * 9/2015 Alneaimi ..... B60R 15/04
2010/0301639 A1 * 12/2010 McPheeters ..... A61G 9/003 297/118

* cited by examiner

*Primary Examiner* — Huyen D Le

(74) *Attorney, Agent, or Firm* — Sanchelima & Associates, P.A.; Christian Sanchelima; Jesus Sanchelima

(57) ABSTRACT

The present invention is a toilet arrangement that provides a user comfortable position while using a toilet seat for a prolonged time. Toilet arrangement includes a toilet and a chair. Toilet is defined with a toilet seat. Chair is defined with a reclining backrest and a seat aperture. Chair is removably positioned to cover toilet such that seat aperture coincides with toilet seat to allow use of toilet by a user seated on chair with user's back resting on reclining backrest. Chair is provided with an adjustable footrest for supporting user's feet while reclining on chair. Also, handrests are provided for supporting user's hand while sitting on chair. Chair is cushioned so that user can have a comfortable sitting for a prolonged time. Seat aperture is also framed with a frame so that one can easily clean.

12 Claims, 3 Drawing Sheets

TOILET ARRANGEMENT FACILITATING COMFORTABLE SITTING OF A USER FOR A PROLONGED TIME

BACKGROUND OF THE INVENTION

1. Field of the Invention.

The present disclosure relates to a toilet seat. More particularly, the present disclosure relates to a toilet arrangement that facilitates a user to sit comfortably on a toilet seat for a prolonged period of time.

2. Description of the Related Art.

Stomach infections or diarrhea causes frequent passing of stools and is troublesome for users to sit on toilet seats for a prolonged period of time due to an uncomfortable position. Hence, there is a need for a toilet arrangement that provides a user comfortable position while using a toilet seat for a prolonged time.

Several designs for various toilet seats have been designed in the past. None of them, however, includes a toilet arrangement for a toilet that provides a user comfortable position while using a toilet seat for a prolonged time.

Applicant believes that a related reference corresponds to a U.S. Pat. No. 6,539,558 filed by KATHRYN SHERO for Multi-function, comfort wheel chair. The KATHRYN SHERO reference discloses improved, multi-function, comfort wheelchair which allows an invalid or a physically disabled individual confined to a wheelchair to be comfortably seated in the wheelchair and also avoid transfer to toilet facilities every time bathroom activities are required. However, multi-function comfort wheelchair is structurally complex because of requirement of an electric motor, control means and an assembly housing. Also, a user cannot directly use a toilet and needs a person who can clean up wastes after bowel movements.

Another related application is WIPO patent application number 2012020414 by David Mizrachi for a trolley for transporting individuals of limited capacity in sedentary position on chair. The patent application '414 discloses a carrying structure and three rotatable wheels and carrying structure configured for releasably fixating legs of the chair such that the chair is reversibly mountable on the carrying structure. However, providing such trolley will not help a user to sit comfortably for a prolonged time.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a toilet arrangement that enables a user to comfortably use a toilet seat for a prolonged period of time.

It is another object of the present invention to provide a toilet arrangement that includes a reclining chair for providing comfortable sitting for a prolonged period of time.

It is still another object of the present invention to provide a toilet arrangement that includes a reclining chair removably positioned to cover a toilet seat and chair provides comfortable sitting of user for a prolonged time.

It is yet another object of the present invention to provide a toilet arrangement that includes a chair with a footrest and handrests for comfortable sitting on a toilet.

It is an object of the present invention to provide a toilet arrangement that enables an orthopedic rehab user to comfortably use toilet seat.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
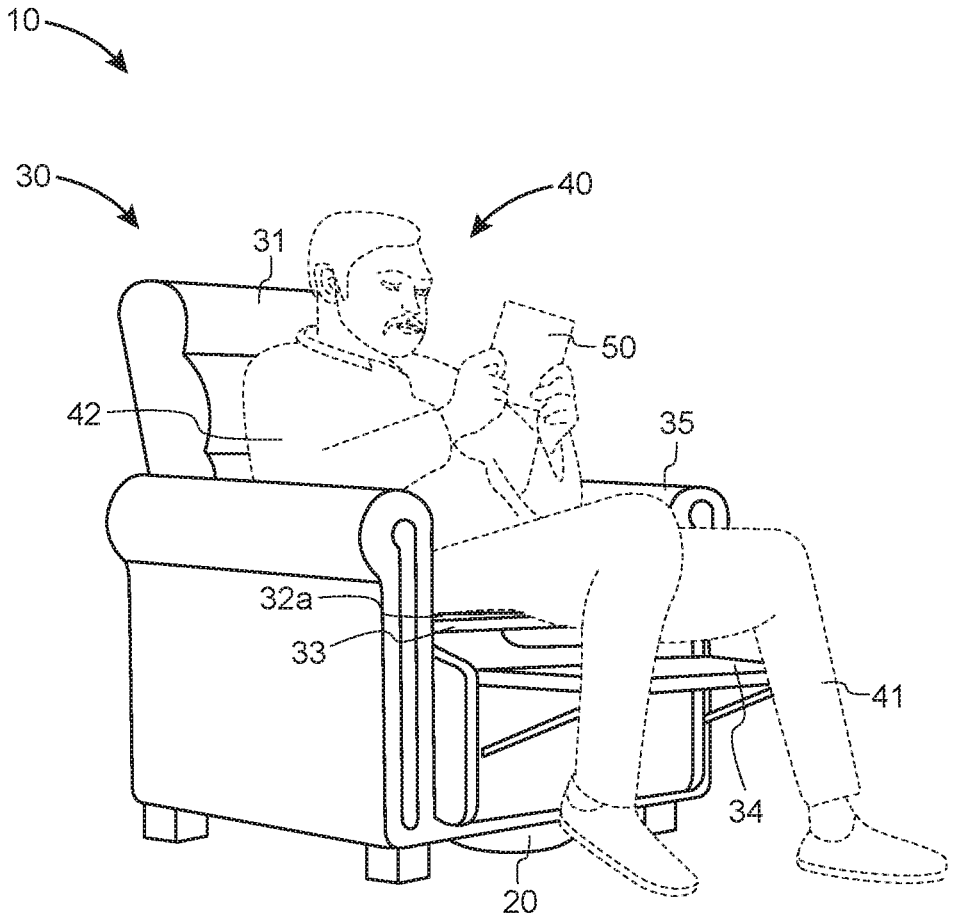
FIG. 1 represents a perspective view of a toilet arrangement 10 that includes a toilet and a chair removably positioned to cover toilet and a user sitting on a chair for using toilet.
Figure 2:
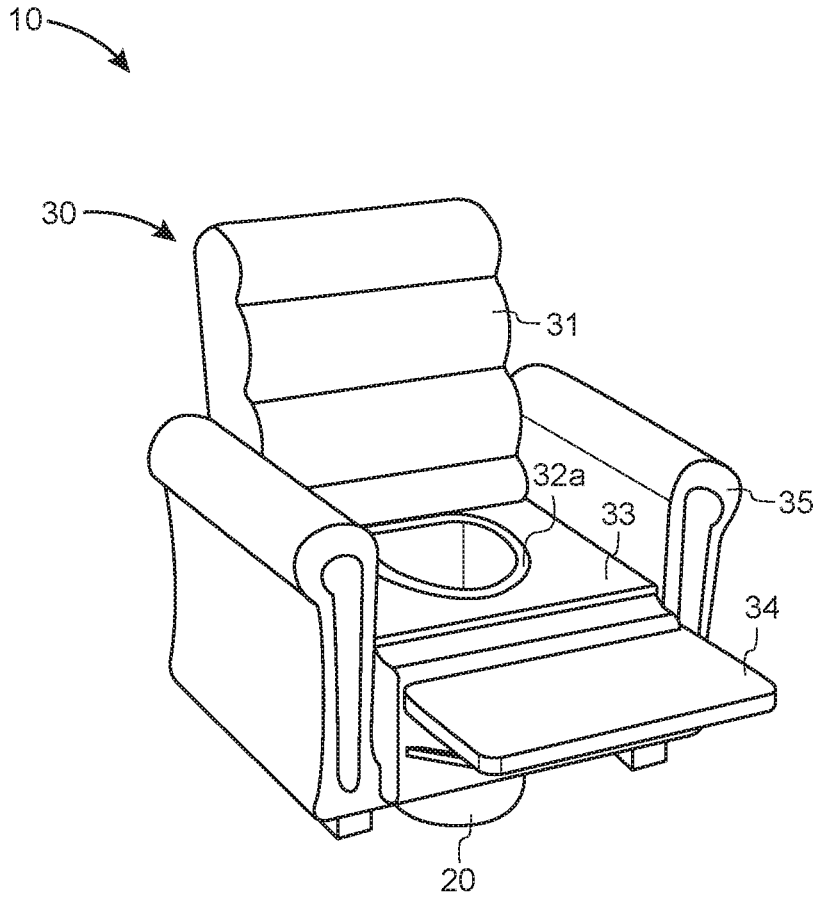
FIG. 2 represents a perspective view of toilet arrangement 10 depicting an aperture of chair positioned on toilet.
Figure 3:
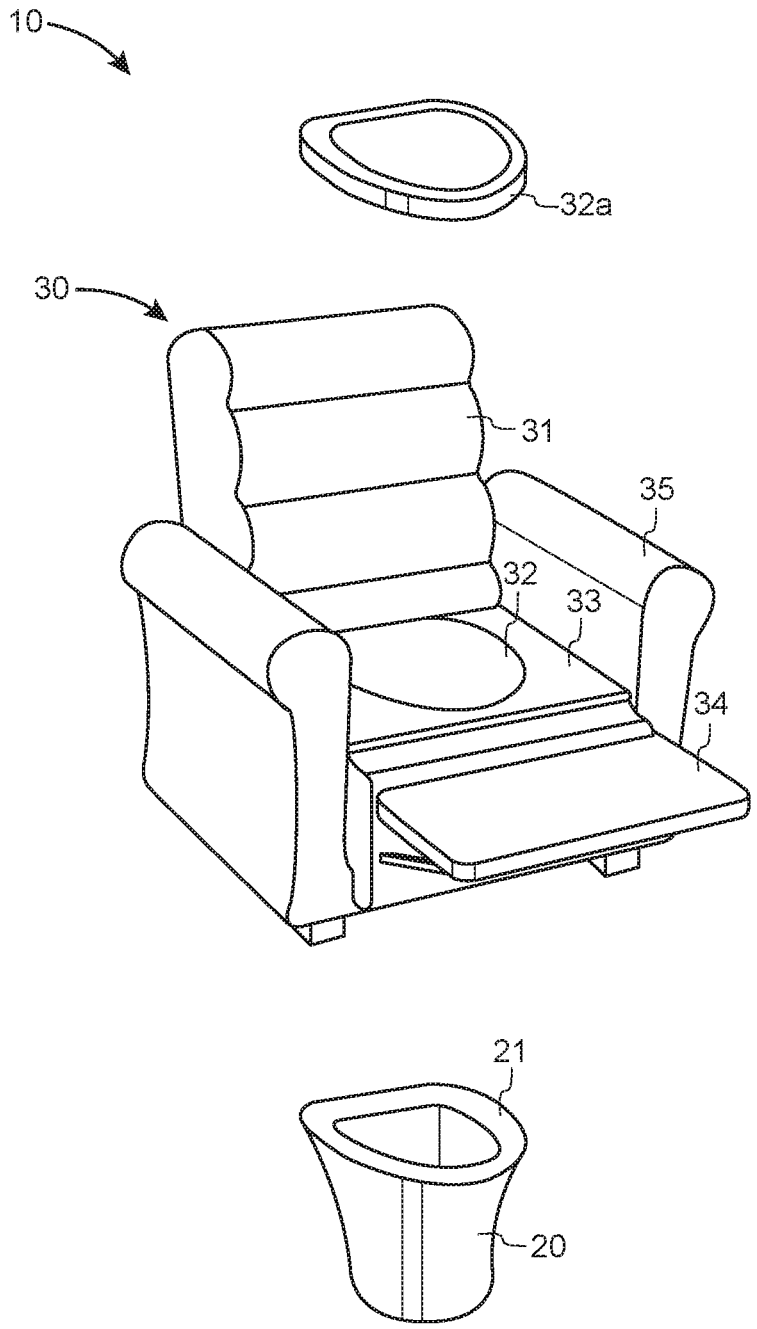
FIG. 3 represents an exploded view of toilet arrangement 10.

Referring now to the drawings, FIGS. 1-3, where the present invention is generally referred to with numeral 10, it can be observed that a toilet arrangement, in accordance with one embodiment, is provided that mainly includes a toilet 20 and a chair 30.

Toilet 20 is defined with a toilet seat 21.

Chair 30 is a reclining chair and is removably positioned to cover toilet 20. Chair 30 is defined with a reclining backrest 31 and a seat aperture 32 configured in a seat 33. Chair 30 is removably positioned to cover toilet 20 such that seat aperture 32 coincides with toilet seat 21 to allow the use of toilet 20 by a user 40 seated on chair 30 with user's back 41 resting on reclining backrest 31.

In one embodiment, backrest 31 of chair 30 is reclining backrest 31 so that user 40 can manipulate reclining backrest 31 for achieving a comfortable position while using toilet 20. Backrest 31 can be manipulated by a lever (not illustrated in Figures) or a knob (not illustrated in Figures). In one embodiment, chair 30 is provided with an adjustable footrest 34 for positioning user's feet 41 thereon. In another embodiment, chair 30 can be provided with a non-adjustable footrest 34.

Further, chair 30 can also be provided with handrests 35 on either side of seat 33 for positioning user's hands 42 thereon. Furthermore, chair 30 is provided with cushion which additionally provides comfortable sitting. Cushion is provided at backrest 31, seat 33, footrest 34 and handrests 35. Cushion is covered with a non-permeable layer made of polymeric material which prevents cushion from being wet and is easy for cleaning. Other materials that are non-permeable and provide ease to clean are within the scope of this disclosure.

In an operative configuration when chair 30 is positioned to cover toilet 20, seat aperture 32 coincides with toilet seat 21 so that user sitting on chair 30 in reclining posture can comfortably use toilet 20. In one embodiment, seat aperture 32 is provided with a frame 32*a*. Frame 32*a* is made of a polymeric material or can be made of any other material that can be easy to clean.

Owing to be in a comfortable position, user 40 can perform a plenty of activities while sitting on chair 30 like reading a book or operating a tablet 50 or mobile phone and the like.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A toilet arrangement comprising:

a) a toilet defined with a toilet seat; and b) a chair defined with a reclining backrest, a seat and a seat aperture, said chair removably positioned over said toilet such that said seat aperture coincide with said toilet seat to allow use of said toilet by a user seated on said chair with user's back resting on reclining backrest, said toilet substantially concealed by chair sidewalls, said toilet being partially visible from underneath of said chair sidewalls, said toilet being in constant abutting contact with said seat, said chair including handrests on sides thereof, said handrests extending vertically from said seat, said handrests being entirely solid.

2. The toilet arrangement as claimed in claim 1, wherein said chair has an adjustable footrest.

3. The toilet arrangement as claimed in claim 1, wherein said chair is cushioned for providing comfortable sitting of the user for a prolonged period.

4. The toilet arrangement as claimed in claim 1, wherein said aperture is framed with a frame.

5. The toilet arrangement as claimed in claim 4, wherein said frame is a polymeric material.

6. The toilet arrangement as claimed in claim 4, wherein said frame is atop of said seat.

7. The toilet arrangement as claimed in claim 1, wherein said chair includes a non-adjustable footrest, said non-adjustable footrest being elevated and perpendicular to said chair, said non-adjustable footrest being underneath of said seat.

8. The toilet arrangement as claimed in claim 7, wherein said non-adjustable footrest is secured and supported by rod members, said rod members being entirely underneath of said non-adjustable footrest, said rod members extending diagonally between said chair and said non-adjustable footrest.

9. The toilet arrangement as claimed in claim 8, wherein said rod members are parallel to each other.

10. The toilet arrangement as claimed in claim 1, wherein said reclining backrest includes arched cushions extending outwardly and away from said reclining backrest.

11. The toilet arrangement as claimed in claim 1, wherein said aperture is adjacent to and in abutting contact with said reclining backrest.

12. A toilet arrangement consisting of:

a) a toilet defined with a toilet seat; and b) a chair defined with a reclining backrest, a seat, a seat aperture, a footrest and handrests, said footrest elevated and supported by rod members extending diagonally from said chair to an underside of said footrest, said rod members being parallel to each other, said footrest being perpendicular to said chair, said chair removably positioned over said toilet such that said chair sidewalls partially conceal said toilet, said toilet being partially visible from underneath of said chair sidewalls, said seat aperture coincides with said toilet seat to allow use of said toilet by a user seated on said chair with user's back resting on said reclining backrest, wherein said chair is cushioned for providing comfortable sitting of the user for a prolonged period, wherein said aperture is framed with a frame made of a polymeric material, said frame visible atop of said seat, said reclining backrest cushioned with arched cushions extending outwardly therefrom, said handrests extending from said seat and being entirely solid, an uneven spacing extending about the perimeter of said aperture between said aperture and peripheries of said seat.

* * * * *